United States Patent [19]

Avellino et al.

[11] Patent Number: 4,913,678

[45] Date of Patent: Apr. 3, 1990

[54] ELECTRICAL CONTACT

[75] Inventors: Frank J. Avellino, Russell; Glenn A. Culbertson, Warren, both of Pa.

[73] Assignee: GTE Products Corporation, Stamford, Conn.

[21] Appl. No.: 305,142

[22] Filed: Feb. 2, 1989

[51] Int. Cl.[4] ..... H01R 4/02; H01R 4/18

[52] U.S. Cl. ..... 439/879; 29/860; 439/874

[58] Field of Search ..... 439/874, 879, 885, 887, 439/891; 29/860, 861, 865

[56] References Cited

U.S. PATENT DOCUMENTS

| | | | |
|---|---|---|---|
| 3,717,842 | 2/1973 | Douglas | 29/860 |
| 4,010,538 | 3/1977 | O'Keefe et al. | 29/865 |
| 4,098,449 | 7/1978 | Noesen | 29/861 X |
| 4,682,840 | 7/1987 | Lockard | 439/874 |

*Primary Examiner*—Eugene F. Desmond

*Attorney, Agent, or Firm*—William H. McNeill

[57] ABSTRACT

An electrical contact comprises a first end which is hollow and bullet shaped. The first end is formed by rolling sheet material. A second end, which is solid and formed from wire is affixed to the first end at a crimp joint. The joint is formed at a tail or terminus of the first and is rolled about the second end to form a gas tight seal. To complete the connection, a laser weld fuses the edges of the crimp and penetrates into the second end.

2 Claims, 2 Drawing Sheets

ELECTRICAL CONTACT

TECHNICAL FIELD

This invention relates to electrical contacts and more particularly to electrical contacts having ends of different diameters and different constitutions.

BACKGROUND ART

Electrical contacts having a circular cross-section have often been made by forming and rolling flat sheet material. One such contact had a first end with a given diameter and a second end with a lesser diameter. When such a contact is utilized in an insulative connector design which requires bending of the second end, it is not unusual for material fracturing to occur, which decreases the reliability of the connector. Further, the rolled second end may have stamping burrs thereon and exhibit difficulty in soldering.

SUMMARY OF THE INVENTION

It is therefore, an object of this invention to obviate the disadvantages of the prior art.

Yet another object of the invention is to enhance electrical contacts.

These objects are accomplished, in one aspect of the invention, by the provision of an electrical contact which has a first hollow, bullet shaped end formed by rolling sheet material; and a second, solid, wire-like end affixed to said first end at a crimp joint, said crimp joint being formed from a tail of said first end and being rolled about said second end to form a gas tight seal.

The mating peripheral petal edges of the crimp seal coact with each other and the second end to form a trough. A laser weld is located on the crimp petals, the weld joining the petals and penetrating the second end. The second end is thus effectively prevented from being removed.

This contact, with its solid second end and its larger diameter first end provides easy bendability, solderability, and elimination of stamping burrs on the second end. The weld greatly increases the strength of the joint.

BEST MODE FOR CARRYING OUT THE INVENTION

For a better understanding of the present invention, together with other and further objects, advantages and capabilities thereof, reference is made to the following specification and claims taken in conjunction with the above-described drawings.

Figure 1:
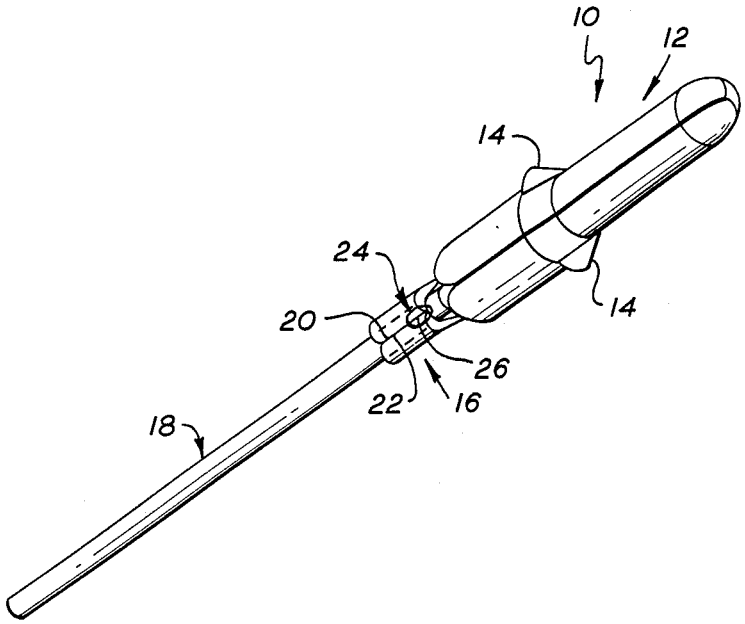
FIG. 1 is a perspective view of an embodiment of the invention.
Figure 2:
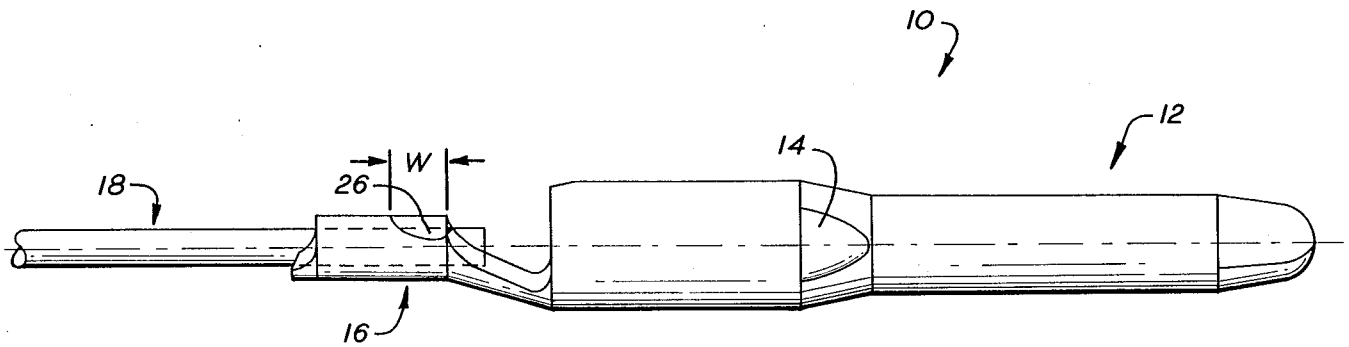
FIG. 2 is an enlarged, fragmentary, elevational view of the contact.

Referring now to the drawings with greater particularity, there is shown in FIG. 1 an electrical contact 10 having a first end 12 which is hollow, although presenting a solid surface, and bullet shaped. A pair of diametrically opposed wings 14 are provided for seating the contact in a connector body. The first end 12 is provided at one terminus with a crimp joint 16. A second end 18, which is solid, and wire-like and has a diameter less than the diameter of the first end is affixed to the first end 12 at the crimp joint 16.

The first end 12 is formed by rolling formed sheet material, such as 70-30 brass which is copper plated and solder plated. The second end 18 is the same material in wire form.

The peripheral joining edges or petals 20, 22 of the crimp joint 16 are serrated. When the first end 12 and the second end 18 are assembled together, the serrated edges penetrate the material of the second end, thus helping to form a rigid, gas tight seal. To increase the rigidity and add to the reluctance of second end 18 to separate from the crimp joint 16, a laser weld 24 is consummated between the peripheral edges of the crimp seal, in trough 26. The weld joins the petal edges and penetrates into the material of the second end, thus forming and extremely resistant joint. Preferably, the weld extent covers ⅓ of the crimp joint length, beginning at the end of the crimp closest to the widest diameter of the first end.

While there have been shown and described what are at present considered to be the preferred embodiments of the invention, it will be apparent to those skilled in the art that various changes and modifications can be made herein without departing from the scope of the invention as defined by the appended claims.

We claim:

1. An electrical contact comprising: a first hollow, bullet shaped end formed by rolling sheet material; a second, solid, wire-like end affixed to said first end at a crimp joint, said crimp joint being formed from a tail of said first end and being rolled about said second end to form a gas tight seal, the mating peripheral petal edges of said crimp seal contacting each other and said second end to form a trough; and a laser weld located on said crimp petals, said weld joining said petals and penetrating said wire-like second end to effectively prevent said second end from being axially removed.

2. The electrical contact of claim 1 wherein said weld occupies about ⅓ of the length of said crimp joint.

* * * * *